US009995013B2

(12) United States Patent
Zhang et al.

(10) Patent No.: US 9,995,013 B2
(45) Date of Patent: Jun. 12, 2018

(54) ECONOMICAL DEBRIS FLOW BLOCKING DAM STRUCTURE AND CONSTRUCTION METHOD THEREOF

(71) Applicant: PowerChina Huadong Engineering Coporation Limited, Hangzhou (CN)

(72) Inventors: Gangping Zhang, Hangzhou (CN); Dengyin Wang, Hangzhou (CN)

( * ) Notice: Subject to any disclaimer, the term of this patent is extended or adjusted under 35 U.S.C. 154(b) by 0 days. days.

(21) Appl. No.: 15/626,111

(22) Filed: Jun. 17, 2017

(65) Prior Publication Data

US 2017/0370062 A1 Dec. 28, 2017

(30) Foreign Application Priority Data

Jun. 24, 2016 (CN) ..... 2016 1 0493589

(51) Int. Cl.
*E02B 7/02* (2006.01)
*E02B 8/00* (2006.01)

(52) U.S. Cl.
CPC . *E02B 7/02* (2013.01); *E02B 8/00* (2013.01)

(58) Field of Classification Search
CPC ..... E02B 7/02; E02B 8/00
See application file for complete search history.

(56) References Cited

U.S. PATENT DOCUMENTS 5,788,411 A * 8/1998 Campbell ..... E02B 7/02 405/107
2013/0022399 A1* 1/2013 Pierce, Jr. ..... E02B 3/06 405/31

* cited by examiner

*Primary Examiner* — Tara Mayo-Pinnock
(74) *Attorney, Agent, or Firm* — Wayne & Ken, LLC; Tony Hom

(57) ABSTRACT

The present invention relates to an economical debris flow blocking dam structure and a construction method thereof. The structure has an excavated foundation surface, and a dam body of the blocking dam is composed of a key wall arranged at a dam toe, dam body concrete wrapped on an outer surface of the whole blocking dam, concrete masonry block stones filled inside the blocking dam, and a plurality of drain holes formed in the dam body in a top and twin-side bottom shape; an open and centralized overflow weir is arranged on the top of the blocking dam; an overflow surface has a horizontal middle and extends to two sides along a longitudinal slope i of 10-20%; and the key wall is anchored on the foundation surface through joint bars stretching into bedrock, and an anti-scouring pit is formed close to a downstream side of the key wall.

9 Claims, 2 Drawing Sheets

ECONOMICAL DEBRIS FLOW BLOCKING DAM STRUCTURE AND CONSTRUCTION METHOD THEREOF

TECHNICAL FIELD

The present invention relates to an economical debris flow blocking dam structure and a construction method thereof, and is mainly applicable to blocking structures of debris flow gully control and other similar engineering.

BACKGROUND

Debris flow refers to landslide caused by rainstorm or other natural disasters and accompanied with special floods carrying lots of sediments and stones in a mountainous area or other regions with deep gullies and steep terrains. The debris flow suddenly outbreaks, is ferocious and may carry giant stones. Due to high-speed advancing and powerful energy, the debris flow has extremely severe destruction. The debris flow is a major geological disaster source encountered in China and abroad, and a control manner of the debris flow mainly includes draining or blocking the debris flow or performing comprehensive treatment in combination with the draining and blocking. By counting lots of debris flow control engineering in China and abroad, a control form of combining the draining and blocking is adopted in most of the engineering. Therefore, a blocking dam is widely applied to debris flow control. From the perspective of the existing blocking dam structures in China and abroad, a concrete gravity dam is a main choice of the blocking dam. Because the gravity dam maintains stable by virtue of gravity, the gravity dam is huge in structure, needs lots of cement, gravel aggregate, etc., and is high in engineering investment.

SUMMARY

A technical problem to be solved in the present invention is to provide an economical debris flow blocking dam structure with simple structural design, construction convenience, safety, reliability and strong practicality, and a construction method thereof with respect to the above problems, to reduce concrete usage amount and achieve a purpose of saving investment.

The present invention adopts the following technical solution: the economical debris flow blocking dam structure has an excavated foundation surface, wherein a dam body of the blocking dam is composed of a key wall arranged at a dam toe, dam body concrete wrapped on an outer surface of the whole blocking dam, concrete masonry block stones filled inside the blocking dam, and a plurality of drain holes formed in the dam body in a top and twin-side bottom shape; an open and centralized overflow weir is arranged on the top of the blocking dam; and overflow surface has a horizontal middle and extends to two sides along a longitudinal slope i of 10-20%; and the key wall is anchored on the foundation surface through joint bars stretching into bedrock, and an anti-scouring pit is formed close to the downstream side of the key wall.

The joint bars are arranged in a rectangular shape and have an inter-row spacing of 2-3 m and a diameter of 25 mm; a depth of the joint bars stretching into the bedrock is 1-3 m, and an exposed length is 0.5 m; and a depth h of the key wall is 2-5 m.

The dam body concrete adopts C20 concrete with a thickness d of 1-2 m; block stones in the concrete masonry block stones have a block diameter of more than or equal to 200 mm and mudstone content not exceeding 0.5% and are hard in texture; and fine aggregate concrete of the dam body concrete is prepared by mixing cement, sand and water according to a certain mixture ratio of 1:3:(0.5-0.7).

An orifice size of width*height of each of the drain holes is equal to 0.5*1.0 m, a horizontal spacing is 3-4 m, a vertical clear spacing is 3-4 m, the lowest row of the drain holes 6 is close to surface elevation of an original gully, and a vertical elevation difference is less than or equal to 1.0 m.

Large block stones with a block diameter more than or equal to 60 cm are filled in the anti-scouring pit.

For a blocking dam with a height less than 10 m, the foundation surface is excavated to a bedrock surface or appropriately excavated.

For a blocking dam with a height exceeding 10 m, the foundation surface is excavated to a moderate weathering upper end.

For the blocking dam with the height less than 10 m, a construction method for the economical debris flow blocking dam structure in the present invention includes the following steps:

a. excavating a foundation surface: excavating the foundation surface to a bedrock surface or appropriately excavating;

b. arranging joint bars: arranging the joint bars in a rectangular shape, wherein a depth of the joint bars stretching into the bedrock is 1-3 m, an exposed length is 0.5 m, a diameter of the joint bars is more than or equal to 25 mm and an inter-row spacing is 2-3 m; and arranging two rows of the joint bars in parallel;

c. arranging a key wall: arranging the key wall at a dam toe of the blocking dam, and anchoring the key wall on the foundation surface through the joint bars stretching into the bedrock, wherein a depth h is 2-5 m;

d. pouring dam body concrete: wrapping the dam body concrete on an outer surface of the whole blocking dam, and adopting C20 concrete with a thickness d of 1-2 m;

e. constructing concrete masonry block stones: filling the concrete masonry block stones inside the blocking dam by taking the dam body concrete as a formwork, starting construction of the concrete masonry block stones after the dam body concrete reaches design strength; firstly stacking the block stones in a middle design area of the dam body, pouring cement mortar into the middle design area, and randomly filling the block stones with larger particle size, wherein the block stones in the concrete masonry block stones have a block diameter more than or equal to 200 mm and mudstone content not exceeding 0.5% and are hard in texture; and fine aggregate concrete of the dam body concrete is prepared by mixing cement, sand and water according to a certain mixture ratio of 1:3:(0.5-0.7);

f. arranging drain holes: arranging 2-3 rows of the drain holes distributed in a top and twin-side bottom shape on the dam body of the blocking dam, wherein an orifice size of width*height of each of the drain holes is equal to 0.5*1.0 m, a horizontal spacing is 3-4 m, a vertical clear spacing is 3-4 m, the lowest row of the drain holes is close to surface elevation of an original gully, and a vertical elevation difference is less than or equal to 1.0 m;

g. arranging an overflow weir: arranging an open overflow weir on the top of the blocking dam, and centralizing the overflow weir, wherein an overflow surface has a horizontal middle and extends to two sides along a longitudinal slope i of 10-20%; and h. forming an anti-scouring pit: forming the anti-scouring pit close to the downstream side of the key wall; and filling large block stones with good integrity and a block diameter not less than 60 cm in the anti-scouring pit.

For the blocking dam with the height exceeding 10 m, a construction method for the economical debris flow blocking dam structure in the present invention includes the following steps:

a. excavating a foundation surface: excavating the foundation surface to a moderate weathering upper end;

b. arranging joint bars: arranging the joint bars in a rectangular shape, wherein a depth of the joint bars stretching into the bedrock is 1-3 m, an exposed length is 0.5 m, a diameter of the joint bars is more than or equal to 25 mm and an inter-row spacing is 2-3 m; and arranging 3-4 rows of the joint bars in parallel;

c. arranging a key wall: arranging the key wall at a dam toe of the blocking dam, and anchoring the key wall on the foundation surface through the joint bars stretching into the bedrock, wherein a depth h is 2-5 m;

d. pouring dam body concrete: wrapping the dam body concrete on an outer surface of the whole blocking dam, and adopting C20 concrete with a thickness d of 1-2 m;

e. constructing concrete masonry block stones: filling the concrete masonry block stones inside the blocking dam by taking the dam body concrete as a formwork; starting construction of the concrete masonry block stones after the dam body concrete reaches design strength; firstly stacking the block stones in a middle design area of the dam body, pouring cement mortar into the middle design area, and randomly filling the block stones with larger particle size, wherein the block stones in the concrete masonry block stones have a block diameter more than or equal to 200 mm and mudstone content not exceeding 0.5% and are hard in texture; and fine aggregate concrete of the dam body concrete is prepared by mixing cement, sand and water according to a certain mixture ratio of 1:3:(0.5-0.7);

f. arranging drain holes: arranging 3-4 rows of the drain holes distributed in a top and twin-side bottom shape on the dam body of the blocking dam, wherein an orifice size of width*height of each of the drain holes is equal to 0.5*1.0 m, a horizontal spacing is 3-4 m, a vertical clear spacing is 3-4 m, the lowest row of the drain holes is close to surface elevation of an original gully, and a vertical elevation difference is less than or equal to 1.0 m;

g. arranging an overflow weir: arranging an open overflow weir on the top of the blocking dam, and centralizing the overflow weir, wherein the overflow surface has a horizontal middle and extends to two sides along a longitudinal slope i of 10-20%; and h. forming an anti-scouring pit: forming the anti-scouring pit close to the downstream side of the key wall and filling large block stones with good integrity and a block diameter not less than 60 cm in the anti-scouring pit.

The present invention has the beneficial effects that: the economical debris flow blocking dam structure in the present invention is of a "silver wrapped in gold" structural form, solves the problem that a blocking dam structure in debris flow control is huge and high in engineering investment, and has simple structural design, construction convenience, safety, reliability and strong practicality.

DETAILED DESCRIPTION

Figure 1:
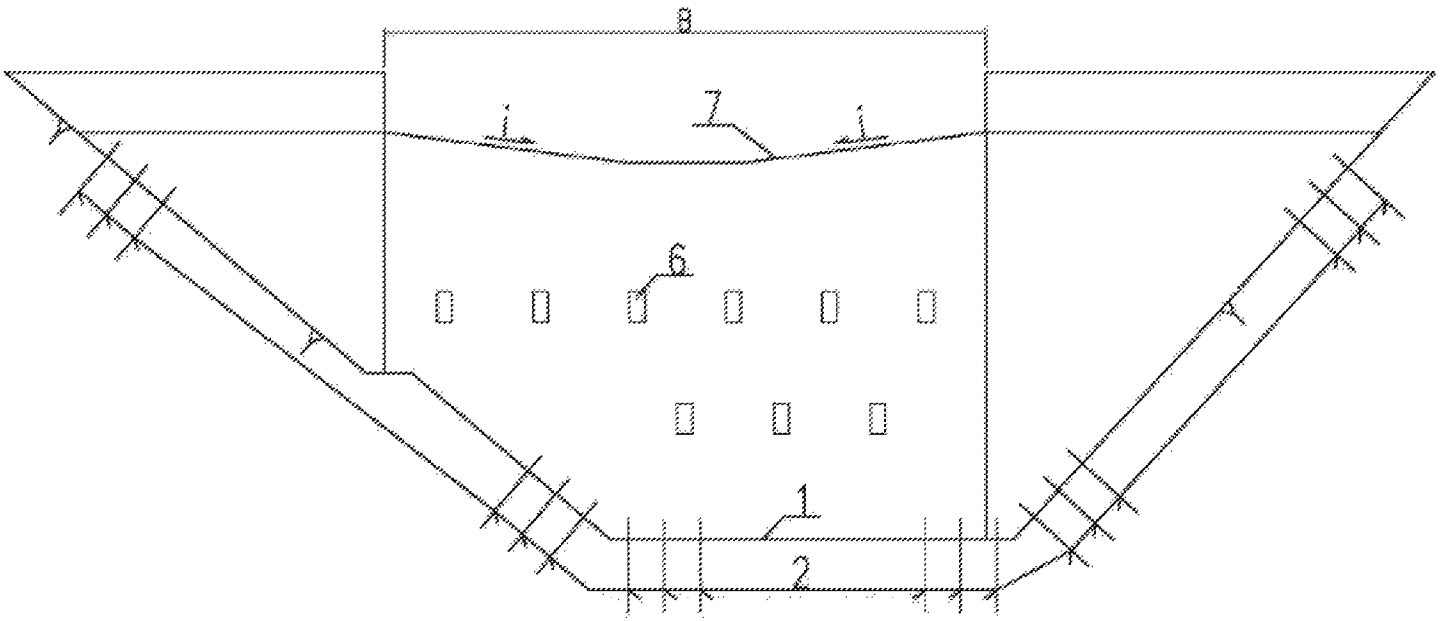
FIG. 1 is an elevation view of an upstream side of the present invention.
Figure 2:
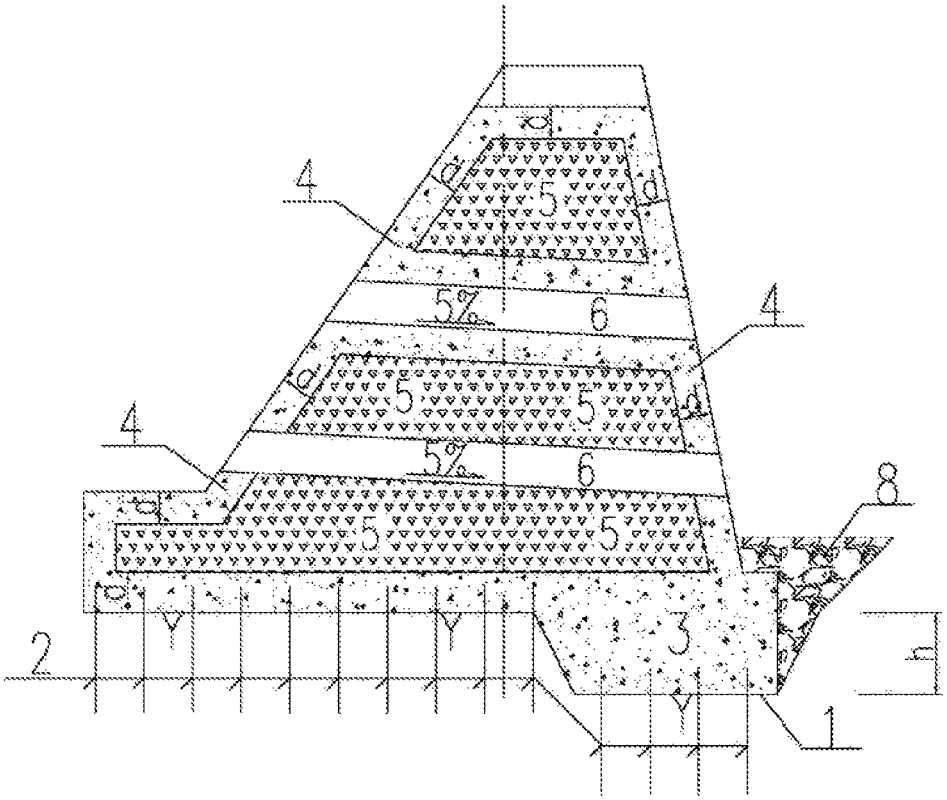
FIG. 2 is a sectional view of the present invention.

As shown in FIG. 1 and FIG. 2, the present embodiment provides an economical debris flow blocking dam structure. For a blocking dam with a height less than 10 m, a foundation surface 1 is excavated to a bedrock surface or appropriately excavated; and for a blocking dam with a height exceeding 10 m, the foundation surface 1 is excavated to a moderate weathering upper end.

A dam body of a blocking dam in the present embodiment is composed of a key wall 3 arranged at a dam toe, dam body concrete 4 wrapped on an outer surface of the whole blocking dam, concrete masonry block stones 5 filled inside the blocking dam, and a plurality of drain holes 6 formed in the dam body in a top and twin-side bottom shape; an open and centralized overflow weir 7 is arranged on the top of the blocking dam; an overflow surface has a horizontal middle over and extends to two sides along a longitudinal slope i of 10-20%; and the key wall 3 is anchored on the foundation surface 1 through joint bars 2 stretching into bedrock, and an anti-scouring pit 8 is formed close to the downstream side of the key wall.

The joint bars 2 are arranged in a rectangular shape and have an inter-row spacing of 2-3 m and a diameter of 25 mm; a depth of the joint bars stretching into the bedrock is 1-3 m, and an exposed length is 0.5 m; and a depth h of the key wall 3 is 2-5 m; the dam body concrete 4 adopts C20 concrete with a thickness d of 1-2 m; block stones in the concrete masonry block stones 5 have a block diameter more than or equal to 200 mm and mudstone content of not exceeding 0.5% and are hard in texture; and fine aggregate concrete of the dam body concrete is prepared by mixing cement, sand and water according to a certain mixture ratio of 1:3:(0.5-0.7); an orifice size of width*height of each of the drain holes 6 is equal to 0.5*1.0 m, a horizontal spacing is 3-4 m, a vertical clear spacing is 3.0-4.0 m, the lowest row of the drain holes 6 is close to surface elevation of an original gully, and a vertical elevation difference is less than or equal to 1.0 m; and large block stones with a block diameter more than or equal to 60 cm are filled in the anti-scouring pit 8.

For the blocking dam with the height less than 10 m, a construction method in the present invention includes the following steps:

a. excavating a foundation surface 1: a blocking structure related to debris flow control generally has a low engineering order, so the foundation surface 1 does not have requirements as strict as those of conventional concrete gravity dams; when a height of the blocking dam is less than 10 m, the foundation surface 1 is excavated to a bedrock surface, and for rock easy to soften when meeting water, the foundation surface 1 can be appropriately excavated; and in order to enable the blocking dam to be uniformly stressed, the foundation surface 1 is required to be as smooth as possible, thereby avoiding great fluctuation;

b. arranging joint bars 2: in order to ensure the stability of the blocking dam and reduce a size of the blocking dam, the joint bars 2 are arranged on a foundation of the blocking dam and required to stretch into the bedrock by 1-3 m, and a specific depth is comprehensively determined according to a dam height, a scale and the like of the blocking dam; an exposed length of the joint bars 2 is about 0.5 m so as to be welded with steel reinforcements of the dam body; a diameter of the joint bars 2 is generally not less than φ25, an inter-row spacing is 2-3 m, and the joint bars 2 are arranged in a rectangular shape; a number of rows of the joint bars 2 is determined according to the dam height of the blocking dam, and when the height of the blocking dam is less than 10 m, generally two rows of the joint bars are arranged in parallel;

c. arranging a key wall 3: the key wall 3 is arranged at a dam toe of the blocking dam in order to enhance the own stability of the blocking dam and prevent the debris flow from scouring the dam toe after passing through the blocking dam; and the key wall is anchored on the foundation surface 1 through the joint bars 2 stretching into the bedrock, wherein a depth h is generally 2-5 m, a specific height is comprehensively determined according to the dam height, the scale and the like of the blocking dam, and the key wall 3 is required to be located on the bedrock and firmly connected with the bedrock by virtue of the joint bars 2;

d. pouring dam body concrete 4: the blocking dam is of a "silver wrapped in gold" structural form so as to reduce concrete usage amount; the dam body concrete 4 is wrapped on an outer surface of the whole blocking dam, and C20 concrete with a thickness d of 1-2 m is adopted; and because the dam body concrete 4 is a formwork of subsequent concrete masonry block stones 5, pouring quality of the dam body concrete 4 is important, and quality defects such as cracks and the like in the dam body concrete 4 should be avoided;

e. constructing concrete masonry block stones 5: the concrete masonry block stones 5 are mainly taken as a filling body of the blocking dam for achieving effects of supporting the outer dam body concrete 4 and the like; the concrete masonry block stones 5 of C15 fine aggregate are filled inside the blocking dam by taking the dam body concrete 4 as the formwork; construction of the concrete masonry block stones 5 is started after the dam body concrete 4 reaches design strength: firstly stacking the block stones in a middle design area of the dam body first, pouring cement mortar into the middle design area, and randomly filling the block stones with larger particle size by utilizing the characteristics of the cement mortar such as high fluidity, high separation resistance and autoflowability, wherein the concrete masonry block stones 5 are formed by mutually cementing the block stones and the C15 fine aggregate and are similar to rock-filled concrete, but the construction process and design technical indexes of the concrete masonry block stones are lower than those of the rock-filled concrete; the block stones in the concrete masonry block stones 5 have a block diameter not less than 200 mm and mudstone content not exceeding 0.5% and are hard in texture; and the fine aggregate concrete is prepared by mixing cement, sand and water according to a certain mixture ratio of 1:3:(0.5-0.7) generally;

f. arranging drain holes 6: the drain holes 6 of the dam body are mainly used for draining accumulated water in front of the dam, an orifice size is generally 0.5*1.0 m (width*height), and a specific width can be calculated and determined according to a following formula; a horizontal spacing of the drain holes is 3-4 m; for an engineering in which a dam height of the blocking dam is less than 10 m, generally 2-3 rows of the drain holes 6 of the dam body are arranged; and a vertical clear spacing is 3-4 m, the drain holes are arranged in a top and twin-side bottom shape, the lowest row of the drain holes 6 of the dam body is close to surface elevation of an original gully, and a vertical elevation difference is generally not more than 1.0 m, so that accumulated water in the gully is drained in time;

g. arranging an overflow weir 7: an open overflow weir 7 is arranged on the top of the blocking dam, and centralized, wherein an overflow surface has a horizontal middle and extends to two sides along a longitudinal slope i of 10-20% in general case; and during construction, the surface of the overflow weir 7 should be ensured to be smooth, and for an engineering in which the height of the blocking dam is large, anti-scouring and wearable concrete is added on the surface of the overflow weir 7 depending on the circumstances;

for a design of an orifice size of the overflow weir 7, an initial width B is decided according to experiences by combining a dam body length, topographic conditions and the like, and whether the initial size B meets design requirements is analyzed by calculating through the following formula:

$$B_y = Q/(Cm\varepsilon\sigma\sqrt{2g}Hw^{y2})$$

in the formula, $B_y$ represents clear width of the overflow weir, m;

Q represents flow of the overflow weir, $m^3/s$;

C represents an upstream slope influence coefficient and is equal to 0.999;

m represents a flow coefficient and is equal to 0.498;

ε represents a side shrinkage coefficient of 0.9-0.95 and is equal to 0.9;

$\sigma_s$ represents a submerging coefficient and is equal to 1 when not submerged;

$H_w$ represents a depth of water above the weir top, m;

h. designing an anti-scouring pit 8: the anti-scouring pit 8 is formed at a part close to the key wall 3 in order to prevent debris flow draining at a high speed from scouring the dam toe of the blocking dam and filing large block stones in the anti-scouring pit 8, wherein the large block stones are required to have good integrity and a block diameter not less than 60 cm.

For the blocking dam with the height exceeding 10 m, a construction method in the present invention includes the following steps:

a. excavating a foundation surface 1: a blocking structure related to debris flow control generally has a low engineering order, so the foundation surface 1 does not have requirements as strict as those of conventional concrete gravity dams; when a height of the blocking dam exceeds 10 m, the foundation surface 1 is required to be excavated to a moderate weathering upper end; and in order to enable the blocking dam to be uniformly stressed, the foundation surface 1 is required to be as smooth as possible, thereby avoiding great fluctuation;

b. arranging joint bars 2: in order to ensure the stability of the blocking dam and reduce the size of the blocking dam, the joint bars 2 are arranged on a foundation of the blocking dam and required to stretch into the bedrock by 1-3 m, and a specific depth is comprehensively determined according to the dam height, the scale and the like of the blocking dam; an exposed length of the joint bars 2 is about 0.5 m so as to be welded with steel reinforcements of the dam body; a diameter of the joint bars is generally not less than φ25, an inter-row spacing is 2-3 m, and the joint bars are arranged in a rectangular shape; a number of rows of the joint bars 2 is determined according to the dam height of the blocking dam, and when the height of the blocking dam exceeds 10 m, generally 3-4 rows of the joint bars are arranged;

c. arranging a key wall 3: the key wall 3 is arranged at a dam toe of the blocking dam in order to enhance the own stability of the blocking dam and prevent the debris flow from scouring the dam toe after passing through the blocking dam, and the key wall is anchored on the foundation surface 1 through the joint bars 2 stretching into the bedrock, wherein a depth h is generally 2-5 m, a specific height is comprehensively determined according to the dam height, the scale and the like of the blocking dam, and the key wall 3 is required to be located on the bedrock and firmly connected with the bedrock by virtue of the joint bars 2;

d. pouring dam body concrete 4: the blocking dam is of a "silver wrapped in gold" structural form so as to reduce concrete usage amount; the dam body concrete 4 is wrapped on an outer surface of the whole blocking dam, and C20 concrete with a thickness d of 1-2 m is adopted; and because the dam body concrete 4 is a formwork of subsequent concrete masonry block stones 5, pouring quality of the dam body concrete 4 is important, and quality defects such as cracks and the like in the dam body concrete 4 should be avoided;

e. constructing concrete masonry block stones 5: the concrete masonry block stones 5 are mainly taken as a filling body of the blocking dam for achieving effects of supporting the outer dam body concrete 4 and the like; the concrete masonry block stones 5 of C15 fine aggregate are filled inside the blocking dam by taking the dam body concrete 4 as the formwork; and construction of the concrete masonry block stones 5 is started after the dam body concrete 4 reaches design strength: firstly stacking the block stones in a middle design area of the dam body first, pouring cement mortar into the middle design area, and randomly filling the block stones with larger particle size by utilizing the characteristics of the cement mortar such as high fluidity, high separation resistance and autoflowability, wherein the concrete masonry block stones 5 are formed by mutually cementing the block stones and the C15 fine aggregate and are similar to rock-filled concrete, but the construction process and design technical indexes of the concrete masonry block stones are lower than those of the rock-filled concrete; the block stones in the concrete masonry block stones 5 have a block diameter not less than 200 mm and mudstone content not exceeding 0.5% and are hard in texture; and the fine aggregate concrete is prepared by mixing cement, sand and water according to a certain mixture ratio of 1:3:(0.5-0.7) generally, and for a blocking dam engineering with great dam height or large scale, the mixture ratio should be determined through relevant tests;

f. arranging drain holes 6: the drain holes 6 of the dam body are mainly used for draining accumulated water in front of the dam, an orifice size is generally 0.5*1.0 m (width*height), and a specific width can be calculated and determined according to a following formula; a horizontal spacing of the drain holes is 3-4 m; for an engineering in which a dam height of the blocking dam is more than 10 m, generally 3-4 rows of the drain holes 6 of the dam body are arranged; and a vertical clear spacing is 3.0-4.0 m, the drain holes are arranged in a top and twin-side bottom shape, the lowest row of the drain holes 6 of the dam body is close to surface elevation of an original gully, and an elevation difference is generally not more than 1.0 m, so that accumulated water in the gully is drained in time;

g. an open overflow weir 7 is arranged on the top of the blocking dam, and centralized; the overflow surface has a horizontal middle and extends to two sides along a longitudinal slope i of 10-20% in general case; and during construction, the surface of the overflow weir 7 should be ensured to be smooth, and for an engineering in which the height of the blocking dam is large, anti-scouring and wearable concrete is added on the surface of the overflow weir 7 depending on the circumstances;

for a design of an orifice size of the overflow weir 7, an initial width B is decided according to experiences by combining a dam body length, topographic conditions and the like, and whether the initial size B meets design requirements is analyzed by calculating through the following formula:

$$B_y = Q/(Cm\varepsilon\sigma_s\sqrt{2g}Hw^{y2})$$

in the formula, $B_y$ represents clear width of the overflow weir, m;

Q represents flow of the overflow weir, $m^3/s$;

C represents an upstream slope influence coefficient and is equal to 0.999;

m represents a flow coefficient and is equal to 0.498;

ε represents a side shrinkage coefficient of 0.9-0.95 and is equal to 0.9;

$\sigma_s$ represents a submerging coefficient and is equal to 1 when not submerged;

$H_w$ represents a depth of water above the weir top, m;

h. designing an anti-scouring pit 8: the anti-scouring pit 8 is formed at a part close to the key wall 3 in order to prevent debris flow draining at a high speed from scouring the dam toe of the blocking dam; and filling large block stones in the anti-scouring pit 8, wherein the large block stones are required to have good integrity and a block diameter not less than 60 cm.

What is claimed is:

1. An economical debris flow blocking dam structure, comprising an excavated foundation surface (1), wherein a dam body of the blocking dam is composed of a key wall (3) arranged at a dam toe, dam body concrete (4) wrapped on an outer surface of the whole blocking dam, concrete masonry block stones (5) filled inside the blocking dam, and a plurality of drain holes (6) formed in the dam body in a top and twin-side bottom shape; an open and centralized overflow weir (7) is arranged on the top of the blocking dam; an overflow surface has a horizontal middle and extends to two sides along a longitudinal slope i of 10-20%; and the key wall (3) is anchored on the foundation surface (1) through joint bars (2) stretching into bedrock, and an anti-scouring pit (8) is formed at a downstream side of the key wall.

2. The economical debris flow blocking dam structure according to claim 1, wherein the joint bars (2) are arranged in a rectangular shape and have an inter-row spacing of 2-3 m and a diameter of 25 mm; a depth of the joint bars stretching into the bedrock is 1-3 m, and an exposed length is 0.5 m; and a depth h of the key wall (3) is 2-5 m.

3. The economical debris flow blocking dam structure according to claim 2, wherein the dam body concrete (4) adopts C20 concrete with a thickness d of 1-2 m; block stones in the concrete masonry block stones (5) have a block diameter of more than or equal to 200 mm and mudstone content of not exceeding 0.5% and are hard in texture; and fine aggregate concrete of the dam body concrete is prepared by mixing cement, sand and water according to a certain mixture ratio of 1:3:(0.5-0.7).

4. The economical debris flow blocking dam structure according to claim 3, wherein an orifice size of width height of each of the drain holes (6) is equal to 0.5*1.0 m, a horizontal spacing is 3-4 m, a vertical clear spacing is 3-4 m, the lowest row of the drain holes (6) is close to surface elevation of an original gully, and a vertical elevation difference is less than or equal to 1.0 m.

5. The economical debris flow blocking dam structure according to claim 4, wherein large block stones with a block diameter of more than or equal to 60 cm are filled in the anti-scouring pit (8).

6. The economical debris flow blocking dam structure according to claim 5, wherein for a blocking dam with a height less than 10 m, the foundation surface (1) is excavated to a bedrock surface or appropriately excavated.

7. A construction method for the economical debris flow blocking dam structure according to claim 6, comprising the following steps:

a. excavating a foundation surface (1): excavating the foundation surface (1) to a bedrock surface or appropriately excavating;

b. arranging joint bars (2): arranging the joint bars (2) in a rectangular shape, wherein a depth of the joint bars stretching into the bedrock is 1-3 m, an exposed length is 0.5 m, a diameter of the joint bars is more than or equal to 25 mm and an inter-row spacing is 2-3 m; and arranging two rows of the joint bars (2) in parallel;

c. arranging a key wall (3): arranging the key wall (3) at a dam toe of the blocking dam, and anchoring the key wall on the foundation surface 11) through the joint bars (2) stretching into the bedrock, wherein a depth h is 2-5 m;

d. pouring dam body concrete (4): wrapping the dam body concrete (4) on an outer surface of the whole blocking dam, and adopting C20 concrete with a thickness d of 1-2 m;

e. constructing concrete masonry block stones (5): filling the concrete masonry block stones (5) inside the blocking dam by taking the dam body concrete (4) as a formwork, starting construction of the concrete masonry block stones (5) after the dam body concrete (4) reaches design strength; firstly stacking the block stones in a middle design area of the dam body; pouring cement mortar into the middle design area; and randomly filling the block stones with larger particle size, wherein the block stones in the concrete masonry block stones (5) have a block diameter of more than or equal to 200 mm and mudstone content not exceeding 0.5% and are hard in texture; and fine aggregate concrete of the dam body concrete is prepared by mixing cement, sand and water according to a certain mixture ratio of 1:3:(0.5-0.7);

f. arranging drain holes (6): arranging 2-3 rows of the drain holes (6) distributed in a top and twin-side bottom shape on the dam body of the blocking dam, wherein an orifice size of width*height of each of the drain holes (6) is equal to 0.5*1.0 m, a horizontal spacing is 3-4 m, a vertical clear spacing is 3-4 m, the lowest row of the drain holes (6) is close to surface elevation of an original gully, and a vertical elevation difference is less than or equal to 1.0 m;

g. arranging an overflow weir (7): arranging an open overflow weir (7) on the top of the blocking dam, and centralizing the overflow weir, wherein an overflow surface has a horizontal middle and extends to two sides along a longitudinal slope i of 10-20%; and h. forming an anti-scouring pit (8): forming the anti-scouring pit (8) at the downstream side of the key wall (3) and filling large block stones with good integrity and a block diameter not less than 60 cm in the anti-scouring pit (8).

8. The economical debris flow blocking dam structure according to claim 5, wherein for a blocking dam with a height exceeding 10 m, the foundation surface (1) is excavated to a moderate weathering upper end.

9. A construction method for the economical debris flow blocking dam structure according to claim 8, comprising the following steps:

a. excavating a foundation surface (1): excavating the foundation surface (1) to a moderate weathering upper end;

b. arranging joint bars (2): arranging the joint bars (2) in a rectangular shape, wherein a depth of the joint bars stretching into the bedrock is 1-3 m, an exposed length is 0.5 m, a diameter of the joint bars is more than or equal to 25 mm and an inter-row spacing is 2-3 m; and arranging 3-4 rows of the joint bars (2) in parallel;

c. arranging a key wall (3): arranging the key wall (3) at a dam toe of the blocking dam, and anchoring the key wall on the foundation surface (1) through the joint bars (2) stretching into the bedrock, wherein a depth h is 2-5 m;

d. pouring dam body concrete (4): wrapping the dam body concrete (4) on an, outer surface of the whole blocking dam, and adopting C20 concrete with a thickness d of 1-2 m;

e. constructing concrete masonry block stones (5): filling the concrete masonry block stones (5) inside the blocking dam by taking the dam body concrete (4) as a formwork, starting construction of the concrete masonry block stones (5) after the dam body concrete (4) reaches design strength; firstly stacking the block stones in a middle design area of the dam body, pouring cement mortar into the middle design area, and randomly filling the block stones with larger particle size, wherein the block stones in the concrete masonry block stones (5) have a block diameter of more than or equal to 200 mm and mudstone content not exceeding 0.5% and are hard in texture; and fine aggregate concrete of the dam body concrete is prepared by mixing cement, sand and water according to a certain mixture ratio of 1:3:(0.5-0.7);

f. arranging drain holes (6); arranging 3-4 rows of the drain holes (6) distributed in a top and twin-side bottom shape on the dam body of the blocking dam, wherein an orifice size of width*height of each of the drain holes (6) is equal to 0.5*1.0 rte, a horizontal spacing is 3-4 a vertical clear spacing is 3-4 m, the lowest row of the drain holes (6) is close to surface elevation of an original gully, and a vertical elevation difference is less than or equal to 1.0 m;

g. arranging an overflow weir (7): arranging an open overflow weir (7) on the top of the blocking dam, and centralizing the overflow weir, wherein an overflow surface has a horizontal middle and extends to two sides along a longitudinal slope i of 10-20%; and h. forming an anti-scouring pit (8): forming the anti-scouring pit (8) at close to the downstream side of the key wall (3) and filling large block stones with good integrity and a block diameter not less than 60 cm in the anti-scouring pit (8).

* * * * *